US012402660B2

(12) United States Patent
Hawkes

(10) Patent No.: US 12,402,660 B2
(45) Date of Patent: Sep. 2, 2025

(54) HANDHELD VAPING IMPLEMENT

(71) Applicant: Curb Living, Inc., South Jordan, UT (US)

(72) Inventor: Matthew Hawkes, South Jordan, UT (US)

( * ) Notice: Subject to any disclaimer, the term of this patent is extended or adjusted under 35 U.S.C. 154(b) by 734 days.

(21) Appl. No.: 17/701,643

(22) Filed: Mar. 22, 2022

(65) Prior Publication Data

US 2023/0301353 A1 Sep. 28, 2023

(51) Int. Cl.

| | |
|---|---|
| ***A24F 40/46*** | (2020.01) |
| ***A24F 40/42*** | (2020.01) |
| ***A24F 40/44*** | (2020.01) |
| ***A24F 40/90*** | (2020.01) |

(52) U.S. Cl.

CPC ..... *A24F 40/46* (2020.01); *A24F 40/42* (2020.01); *A24F 40/44* (2020.01); *A24F 40/90* (2020.01)

(58) Field of Classification Search

None

See application file for complete search history.

(56) References Cited

U.S. PATENT DOCUMENTS

| | | | | |
|---|---|---|---|---|
| 1,775,947 | A | 9/1930 | Robinson | |
| 3,200,819 | A | 8/1965 | Gilbert | |
| 9,877,505 | B2 | 1/2018 | Cameron et al. | |
| 9,936,737 | B2 | 4/2018 | Cameron et al. | |
| 10,561,803 | B2 | 2/2020 | Liu et al. | |
| 10,595,562 | B2 | 3/2020 | Freeman et al. | |
| 10,709,173 | B2 * | 7/2020 | Monsees | A24F 40/42 |
| 10,737,041 | B1 | 8/2020 | Adelaar et al. | |
| 11,083,850 | B2 | 8/2021 | Hatamian et al. | |
| 11,090,449 | B2 | 8/2021 | Hatamian et al. | |
| 11,399,571 | B2 | 8/2022 | Cameron | |
| 11,450,420 | B2 | 9/2022 | Hatamian et al. | |
| 11,571,022 | B2 * | 2/2023 | Lahoud | A24B 15/167 |
| 11,676,438 | B2 | 6/2023 | Hubbard et al. | |
| 11,701,479 | B1 | 7/2023 | Robinson et al. | |
| 11,771,136 | B2 | 10/2023 | Hejazi et al. | |
| 2014/0027384 | A1 | 1/2014 | Little et al. | |
| 2015/0136158 | A1 | 5/2015 | Stevens et al. | |
| 2015/0181945 | A1 | 7/2015 | Tremblay | |
| 2016/0331022 | A1 | 11/2016 | Cameron | |
| 2017/0209840 | A1 | 7/2017 | Swallow et al. | |
| 2019/0167922 | A1 | 6/2019 | Cole | |

(Continued)

FOREIGN PATENT DOCUMENTS

| | | | |
|---|---|---|---|
| AU | 2021101022 | A4 | 4/2021 |
| CN | 201572400 | U | 9/2010 |

(Continued)

OTHER PUBLICATIONS

"SyqeAir Inhaler," webpage <https://syqe.com/product/syqeair/>, last accessed Nov. 8, 2023.

(Continued)

*Primary Examiner* — Philip Y Louie

(74) *Attorney, Agent, or Firm* — Steven Rinehart

(57) ABSTRACT

A vaping device with quick release interchangeable cartridge is disclosed for atomizing and discharging a composition as a mist for inhalation. The detachable cartridge comprises an atomizer, a transparent reservoir and elongated conductors, and is adapted to quickly attach and detach from an ovoid body using a friction fit or magnetic fit.

7 Claims, 11 Drawing Sheets

(56) References Cited

U.S. PATENT DOCUMENTS

| | | | | |
|---|---|---|---|---|
| 2020/0170301 | A1 | 6/2020 | Gallagher et al. | |
| 2020/0222644 | A1 | 7/2020 | Mccullough | |
| 2020/0245692 | A1* | 8/2020 | Cameron | B05B 17/0684 |
| 2020/0245694 | A1 | 8/2020 | Cameron et al. | |
| 2020/0276607 | A1* | 9/2020 | Aherne | B05B 17/0646 |
| 2021/0059301 | A1 | 3/2021 | Hejazi | |
| 2022/0105284 | A1 | 4/2022 | Lahoud et al. | |
| 2022/0132935 | A1 | 5/2022 | Lahoud et al. | |
| 2022/0287365 | A1 | 9/2022 | Alsayar et al. | |
| 2023/0200453 | A1 | 6/2023 | Kilger et al. | |

FOREIGN PATENT DOCUMENTS

| | | | |
|---|---|---|---|
| JP | 2004249208 | A | 9/2004 |
| WO | WO 2020165777 | A1 | 8/2020 |
| WO | WO 2022167856 | A1 | 8/2022 |
| WO | WO 2023017506 | A1 | 2/2023 |
| WO | WO 2023161645 | A2 | 8/2023 |

OTHER PUBLICATIONS

English abstract of CN 201572400 U obtained from Google Patents on Feb. 22, 2024.
English abstract of JP 2024-249208 A obtained from Google Patents on Feb. 22, 2024.
Geekvape Max100 Kit User Manual, pp. 1-6, 2023.
Search Report and Written Opinion in International Application No. PCT/US2023/033491, issued Sep. 22, 2023, 13 pages.
ZICOH demo videos [online], [retrieved on Nov. 15, 2023]. Retrieved from the Internet <URL: https://zicoh.com/demo/>.

* cited by examiner

HANDHELD VAPING IMPLEMENT

FIELD OF THE INVENTION

This invention relates to a diffusing and vaping devices, and more particularly relates to vaping devices with quick release and/or interchangeable cartridge(s) which contain, atomize, and discharge a composition as a mist for inhalation of the misted or diffused substance.

BACKGROUND

Description of the Related Art

Atomizers, generators, nebulizers and the like are designed for a wide variety of purposes such as medical, therapeutic, and cosmetic applications. Vaping using e-cigarettes have become a popular substitute for smoking. Using e-cigarettes, vapers can inhale a diffused liquid containing only the active ingredients instead of traditional substances like tobacco, which contain many toxins and tangential substances, including tar.

Vapers cause small droplets of liquid to be suspended in air. Typically, a vaper is adapted to discharge a mist into the mouth. Traditional misters either are not refillable, or contain a reservoir, that while refillable, is inefficient. These reservoirs are often oil-based, diffusing oil which contaminates lung tissue.

In traditional vaping devices, the atomizer can become clogged with residue, and different sized atomizers are needed for oils of different viscosities, making interchange of a plurality of liquids unfeasible as the atomizer is contaminated and not properly sized. Overcoming this problem in the prior art is desirable.

These difficulties inherent in the devices known in the art tend to make the useful life of a vaper much shorter than would otherwise be desirable. Misters are often discarded, perform less favorably than predicted, are not as efficient in terms of conserving expensive contents and/or not reused as commonly as they might otherwise be if improvements to the art were made and if various contents could be swapped out merely by interchanging cartridges or reservoirs or tanks.

Traditional vaping devices do not provide a means for quickly and cleanly interchanging different types of compositions without residue contaminants. A misting device that is operable with water-based cartridges is desirable.

SUMMARY

From the foregoing discussion, it should be apparent that a need exists for an improved handheld vaping implement. Accordingly, the present invention has been developed to provide a vaping apparatus for dispensing of a composition, the vaping apparatus comprising: an ovoid body comprising a rechargeable battery and a depressible triggering mechanism, the ovoid body defining a hollow interior recess and open top end defining a track within which a protuberance travels; a detachable, ovoid interchangeable cartridge adapted to insert into the open top end, the cartridge detachably engageable with the body, the cartridge comprising: a transparent reservoir having reservoir exterior surfacing, the transparent reservoir defining two conductor channels running longitudinally; a base affixed to the transparent reservoir comprising a protuberance, the base having exterior surfacing recessed inwardly from the reservoir exterior surfacing, the base adapted to insert into the open top end; two elongated, metal conductors each positioned within one of the conductor channels; a ceramic wick adapted to direct fluid housed within the transparent housing to a piezo plate; the piezo plate disposed above the ceramic wick; and a frustoconical tip having an open top end positioned above the transparent reservoir.

The vaping apparatus may further comprise a USB charging port. The vaping apparatus may further comprise a tray inserted into the hollow interior recess adapted to secure the power supply and a triggering mechanism, the tray having a planar top surface defining two or more apertures and a hollow cylindrical recess.

The vaping apparatus may further comprise a plurality of magnets disposed across the top surface of the tray and the ovoid base adapted to form a magnetic fit between the tray and the detachable cartridge.

The tray may further comprise a plurality of threaded protuberances adapted to affix the tray to other components.

The body may be fabricated from a metal alloy. The outlet of the atomizer may comprise an atomizer nozzle.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

It is an object of the present invention to provide a diffusing and vaping device with quick release interchangeable cartridge or reservoir.

For the purposes of this invention, the terms "cartridge," "tank" and "reservoir" are synonymous and interchangeable.

FIGS. 1-4B illustrate various embodiment of a handheld vaping instrument in accordance with the present invention.

Figure 1:
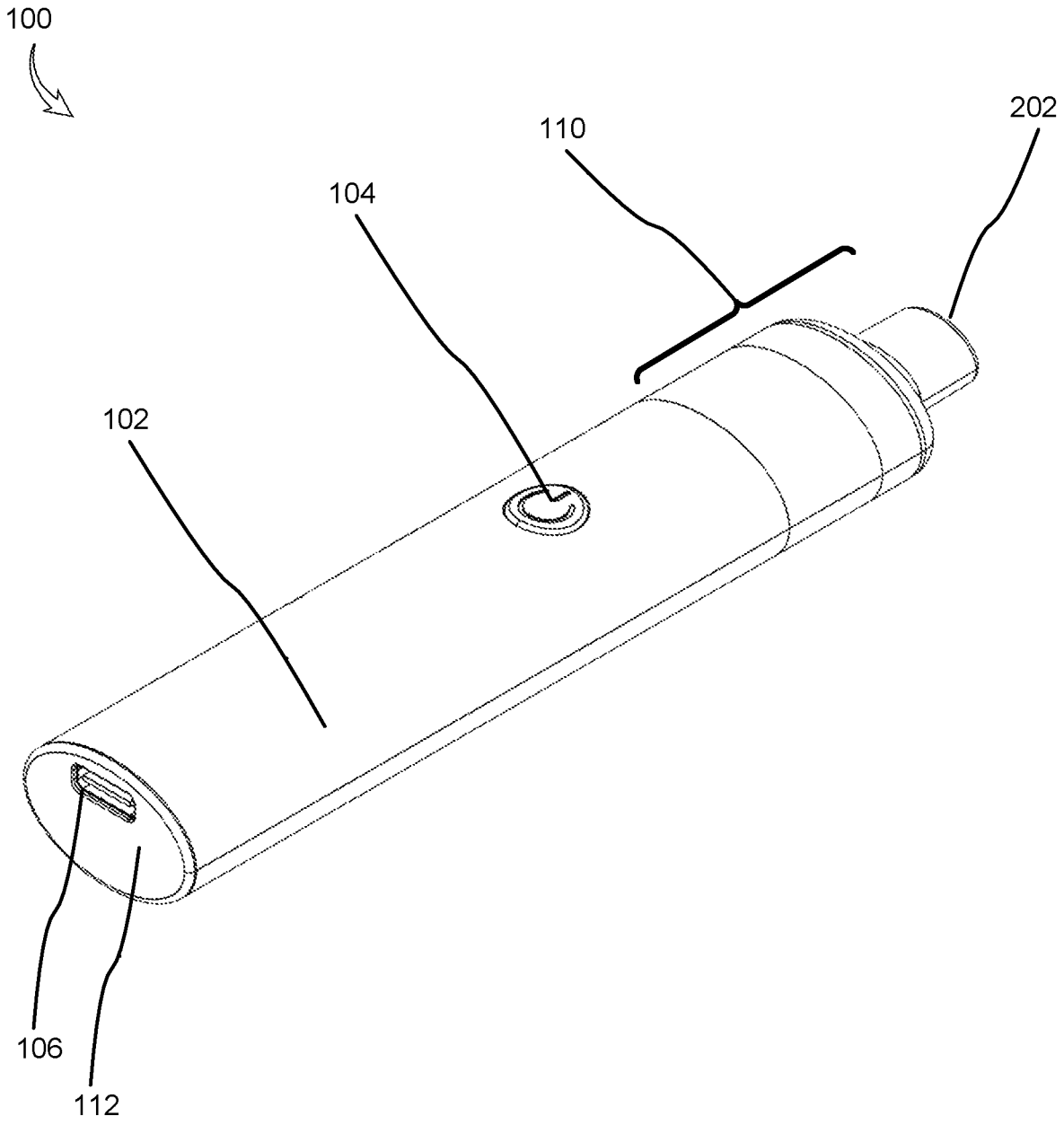
FIG. 1 is an isometric, perspective view illustrating one embodiment of a handheld vaping instrument in accordance with the present invention.
Figure 2:
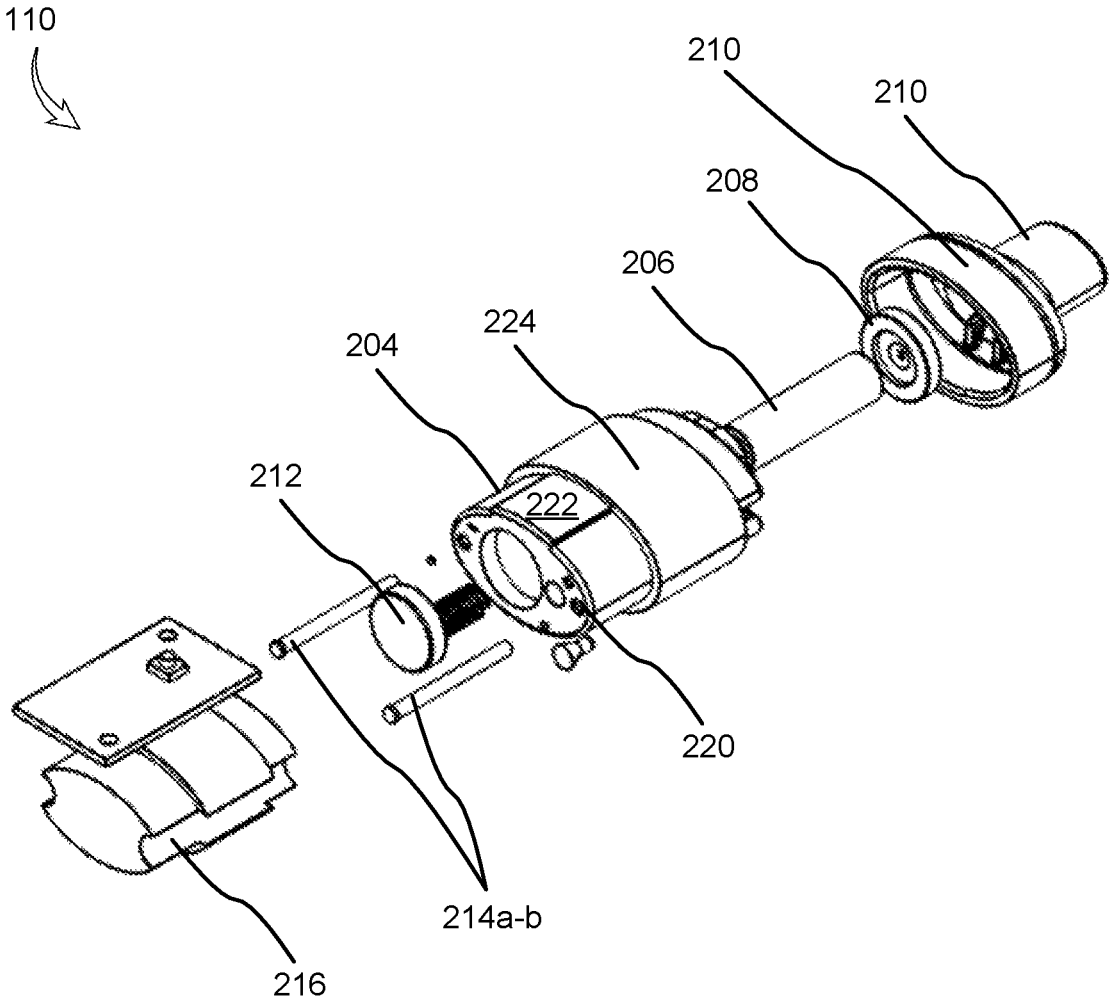
FIG. 2 is an exploded perspective view illustrating one embodiment of a detachable cartridge of a handheld vaping instrument in accordance with the present invention.
Figure 3A:
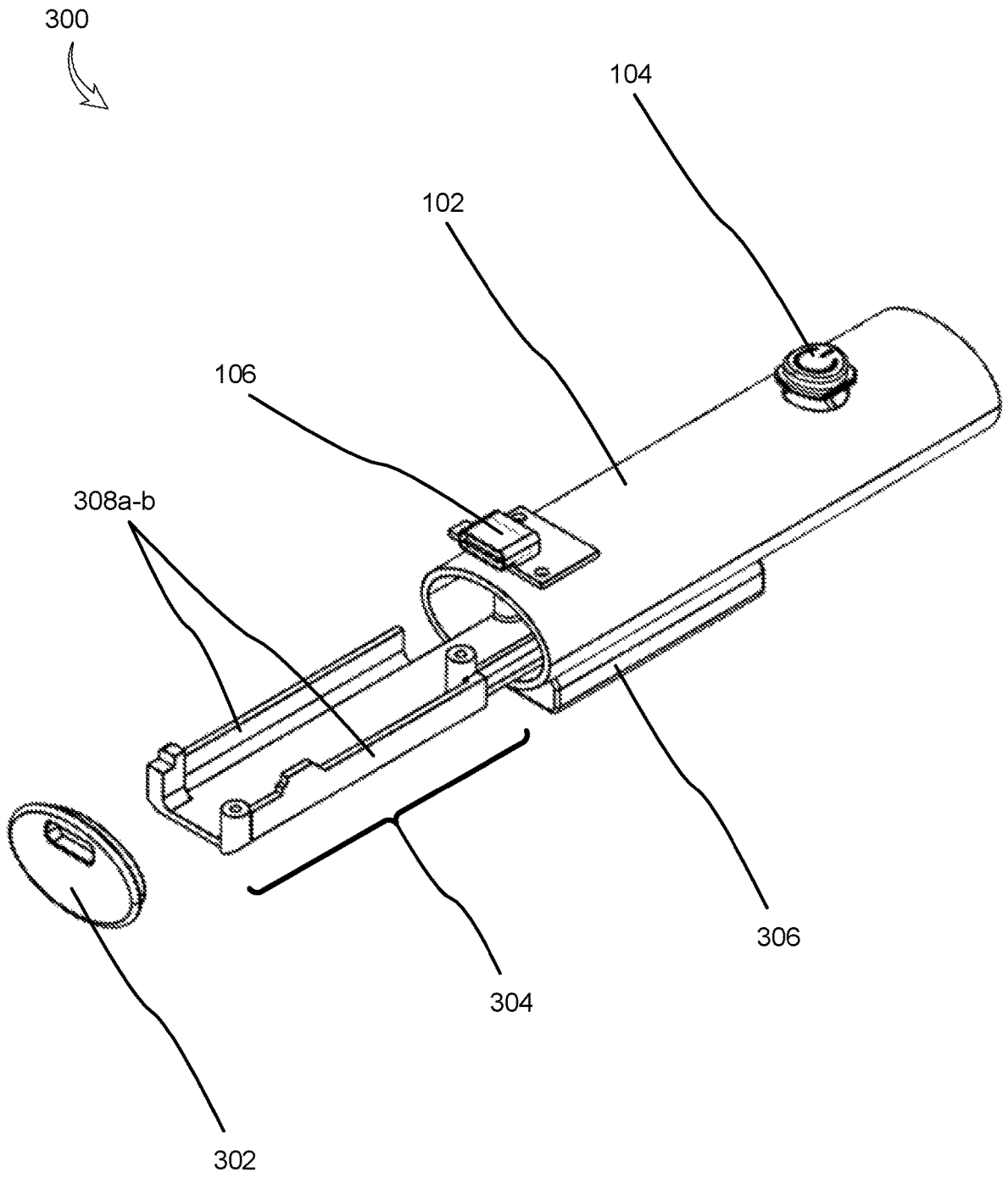
FIG. 3A is an exploded, side-perspective view illustrating one embodiment of a handheld vaping instrument in accordance with the present invention.
Figure 3B:
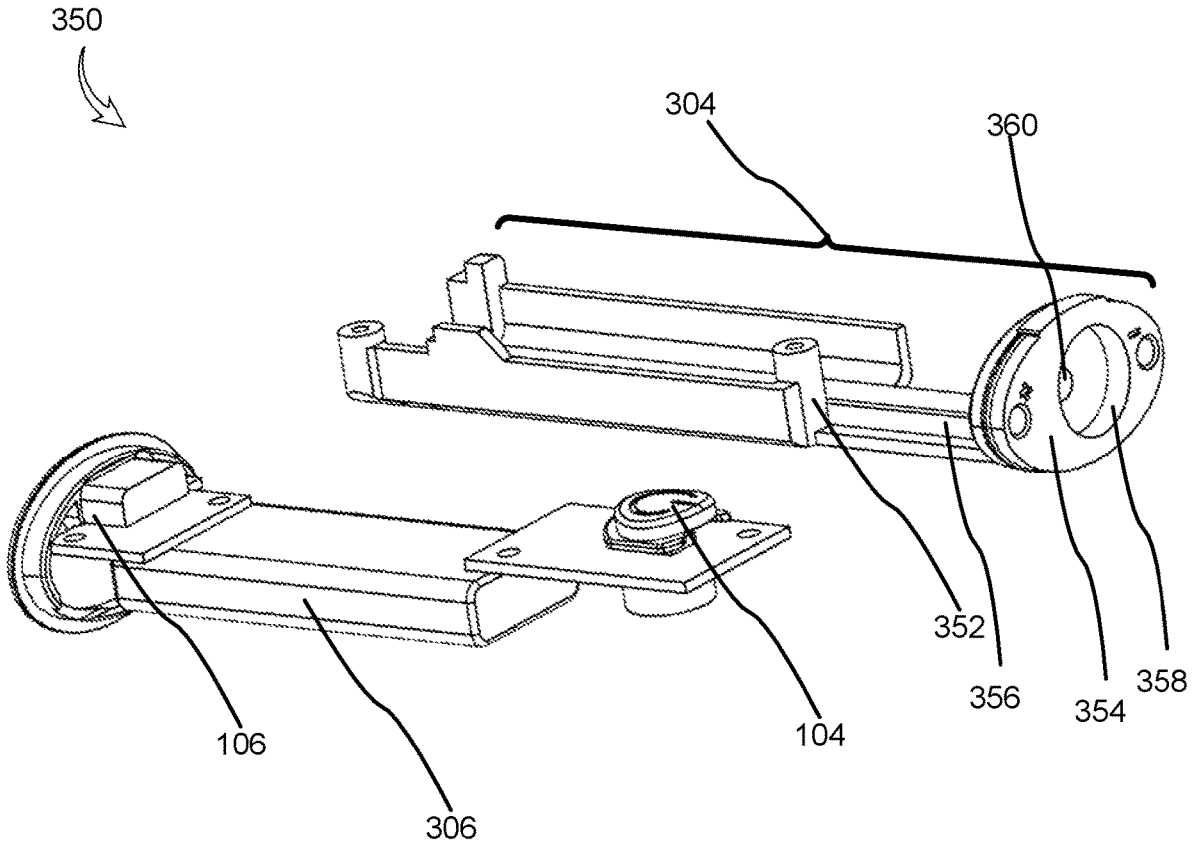
FIG. 3B is an exploded, side-perspective view illustrating one embodiment of a handheld vaping instrument in accordance with the present invention.
Figure 4A:
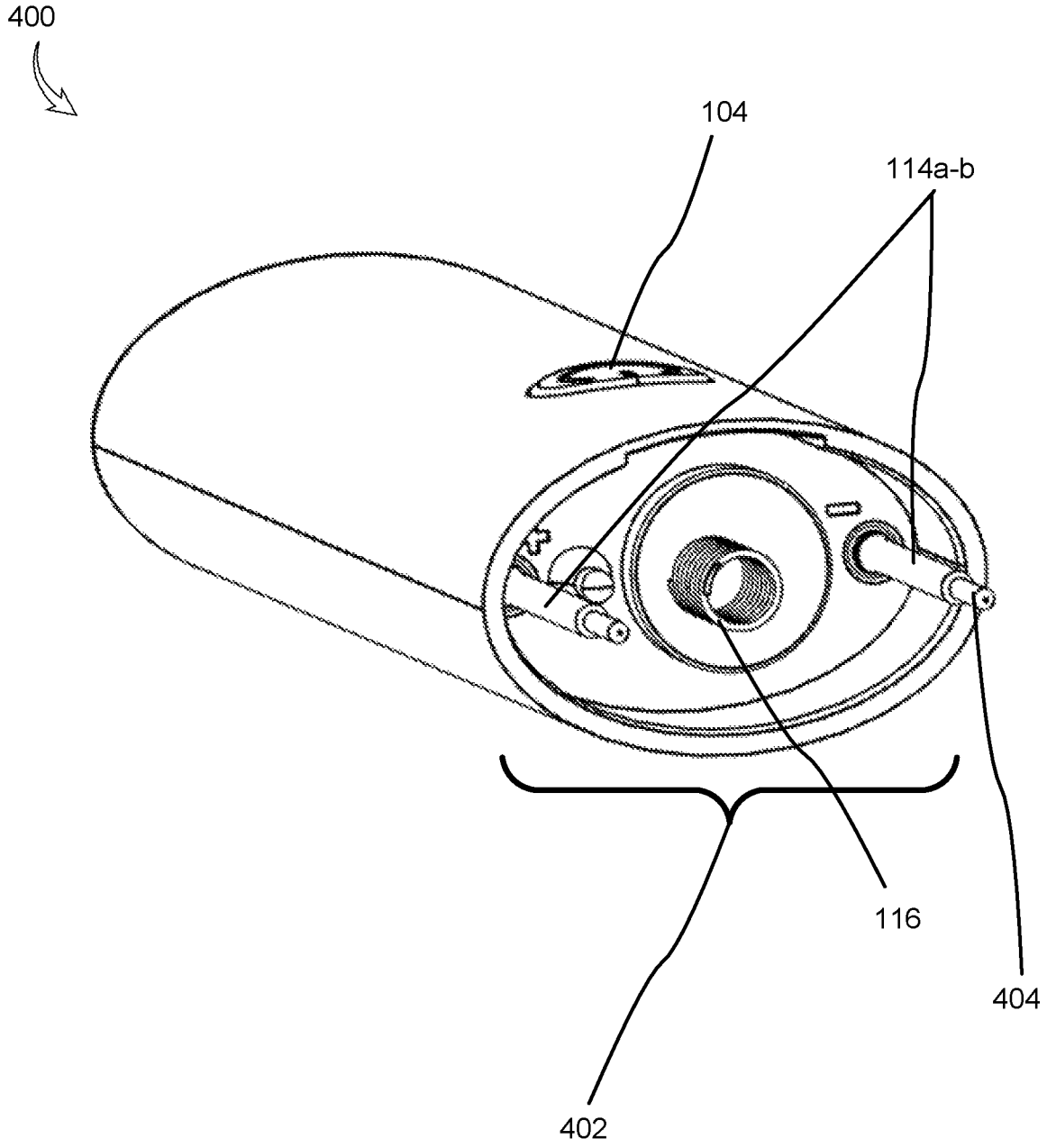
FIG. 4A is a top perspective view illustrating one embodiment of a handheld vaping instrument in accordance with the present invention.
Figure 4B:
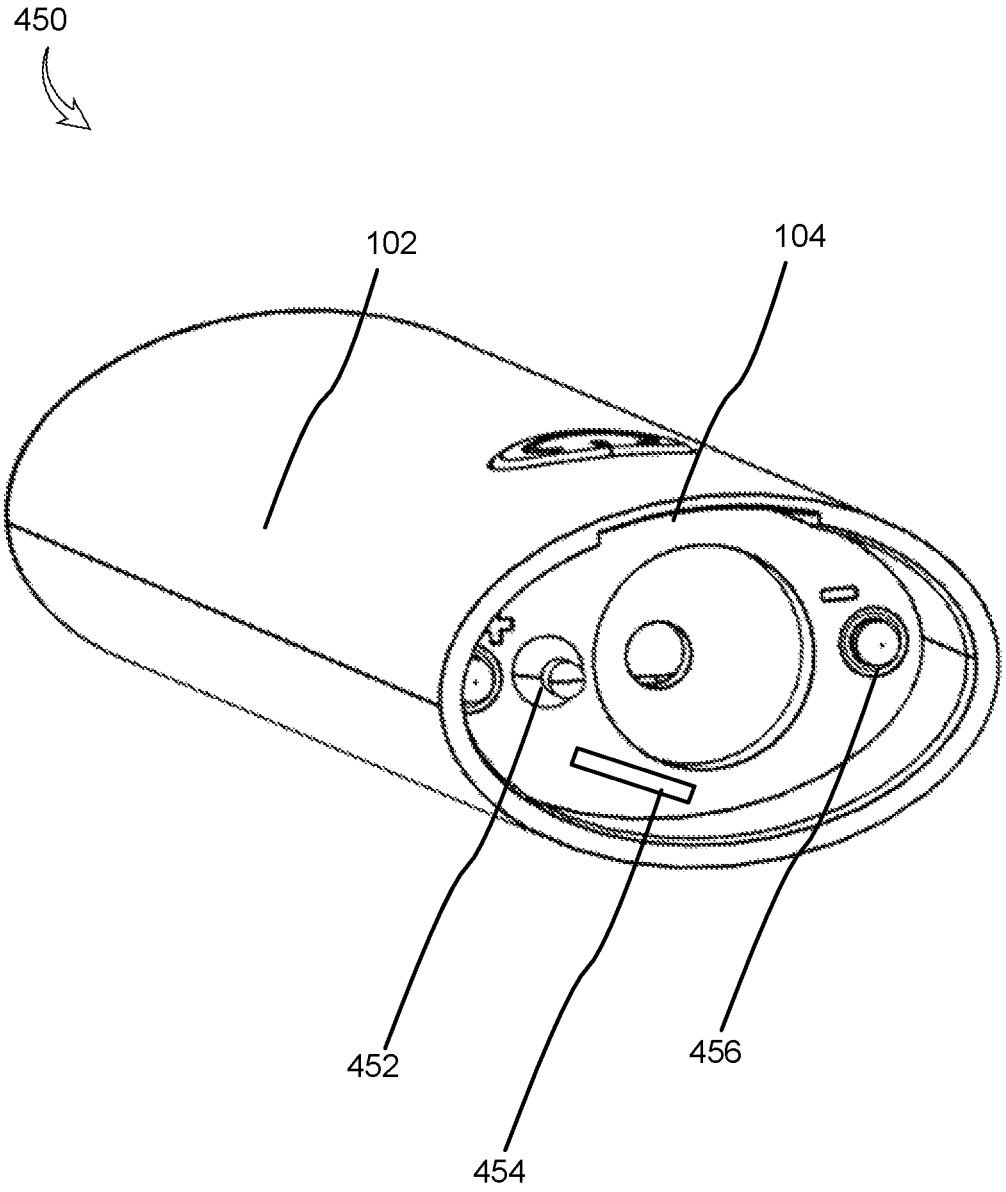
FIG. 4B is a top perspective view illustrating one embodiment of a handheld vaping instrument in accordance with the present invention.

FIG. 1 depicts a vaping device or apparatus 100 with a quick release interchangeable cartridge 110, adapted to discharge a composition as a uniform mist for inhalation. The composition may include, without limitation, a composition having nicotine. The composition may include THC for medicinal use. The composition may be water-based rather than oil-based.

The device 100 provides a quick-release interchangeable cartridge 110 to carry or formulate, contain, and discharge the composition as a uniform mist into the mouth of a user/vaper. In some embodiments, this cartridge 110 may be refillable, and may comprise means known to those of skill in the art for refilling a cartridge, including a screw-down cap, a stopper, a valve, and the like.

The composition may be formulated directly in an interchangeable cartridge 110 or may be pre-formulated and filled and then quickly loaded into an interior chamber of a container 102 (or base 102) for one-handed vaping. The composition is atomized to enable formation of the uniform mist. A base 102 maintains the interchangeable cartridge 110 in an upright or horizontal disposition.

The cartridge 110 comprises an open end 202 (or misting nozzle), which may engages a cap.

A triggering mechanism, or depressible button 104, is triggered by a user to activate the device 100 on the base 102, which expels atomized fluid from the misting nozzle 202 into a user's mouth after activating a piezo plate 208.

In various embodiments, the base 102 comprises an internal battery 306, which is charged via a USB port 106.

The body 102, or base 102, may be cylindrical or oblong from a lower perspective (i.e., ovoid from a lower and upper perspective). The detachable cartridge 110 is also ovoid or oblong and of the same dimensions from a lower perspective view. A USB port 106 positions within a recess on the lower surface 112.

In various embodiments, the interchangeable cartridge 110 comprises a frustoconical 210 tip with an open end 202 (or nozzle 202) from which atomized fluid or mist is dispensed. A piezo plate 208 positions between the nozzle 202 and a ceramic wick 206. Fluid housed within a transparent housing 224 (or transparent reservoir 224) is inducted up the wick 206 to the piezo plate 208 and atomized.

Two elongated, metal conductors 214*a-b* position within tracks 216 defined on one of a lower cartridge component 218 and the transparent housing 224. These conductors 214*a-b* conduct electricity to the piezo plate 208 upon activation of a tactile or depressible button 104. These conductors 214*a-b* may also traverse conductor channels 220, or bores, in the transparent housing 202.

The conductors 114 may taper at a distal end 404, or be more narrow at said distal ends 404.

The base 102 may be formed from polymeric or metal alloy materials, including aluminum.

An ovoid base 204 affixes to the transparent housing 224. In some embodiments, the ovoid base 204 is formed as a single integrated piece with the transparent housing 202. The apparatus 200 may comprise or consist of all the shown components.

The ovoid base 204 has exterior surfaces which is recessed inward from that of the transparent housing 224 such that the ovoid base may insert into the open top end 402 of the base 102. A protuberance 222 rises from the ovoid base 204 which mates with a corresponding track 104 (or recess) on the base 102.

The base 102 defines a hollow interior recess in which a tray 304 is disposed.

In various embodiments, a plurality of magnets 454 affix to the tray 304 and to the base 102 adapted to secure the interchangeable cartridge 110 in place by forming a magnetic fit with magnets affixed to the interchangeable cartridge 110.

The base 102 may comprise a spring 116.

The planar top surface 354 of the tray 304 may define two or more apertures 456.

The tray 304 comprises two sidewalls 308. The tray secures the USB port 106 and various components relating to the button 104, including the battery 306 and/or the button 104. The tray 304 may comprise a planar top face 354 and planar rearward surface 356. The tray 304 may comprise a plurality of threaded, cylindrical protuberances 352 adapted to affix to other components of the apparatus 300. The top surface 354 of the tray 304 may also define a hollow cylindrical recess 358 having a bore 360.

FIGS. 5-8 illustrate various embodiments of a handheld vaping instrument in accordance with the present invention.

Figure 5:
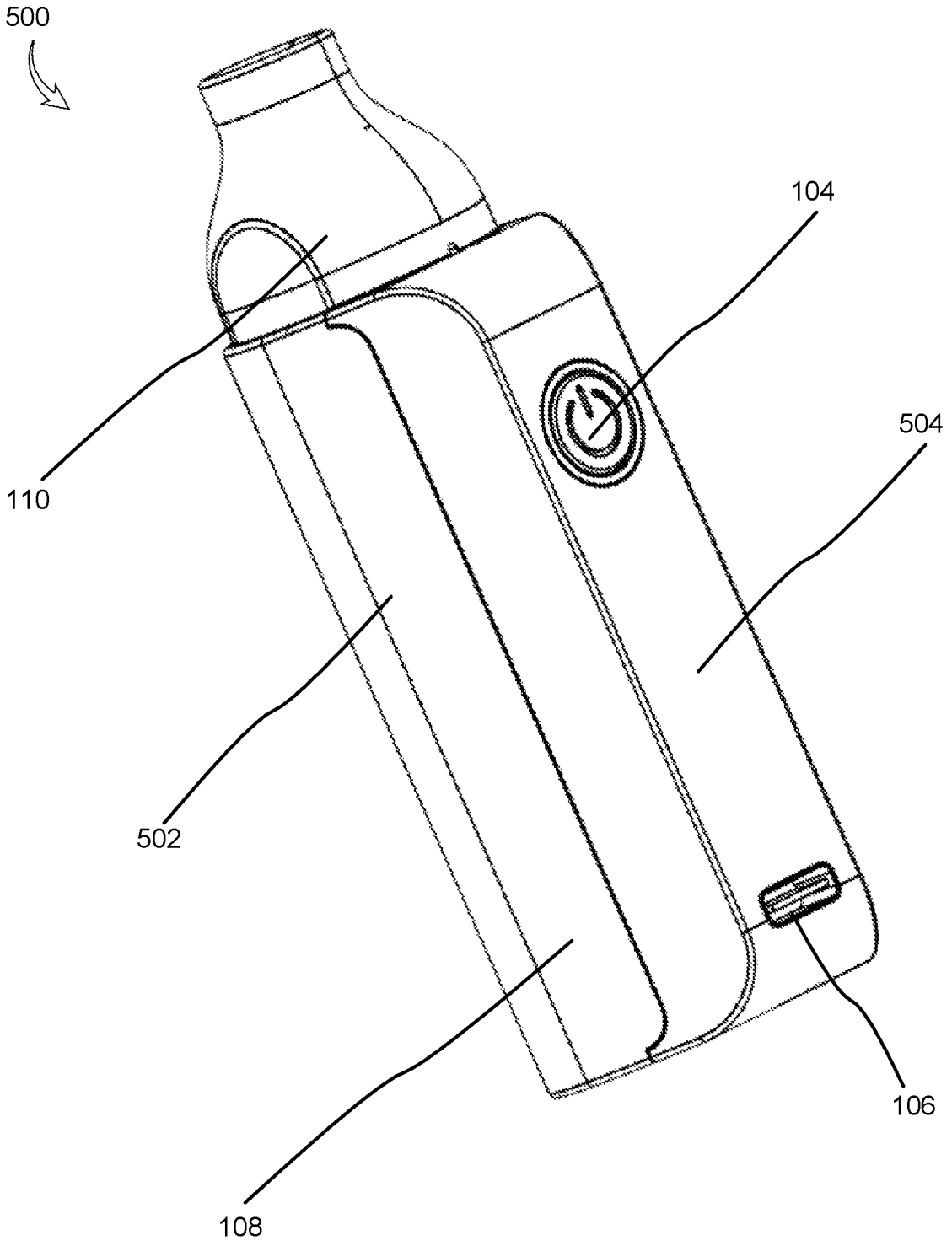
FIG. 5 is a side perspective view illustrating one embodiment of a handheld vaping instrument in accordance with the present invention.
Figure 6:
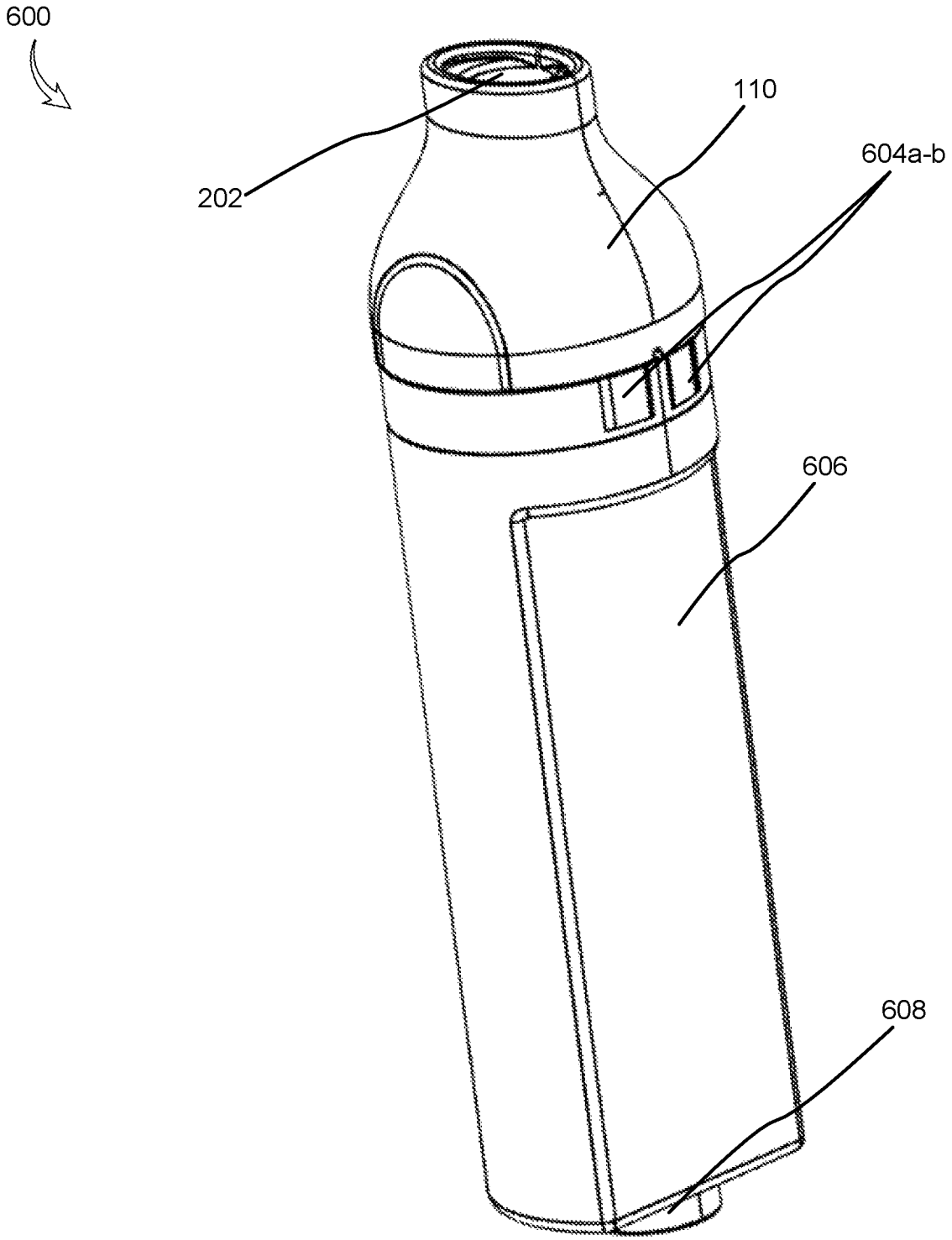
FIG. 6 is an exploded, side-perspective view illustrating one embodiment of a detachable cartridge of a handheld vaping instrument in accordance with the present invention.
Figure 7:
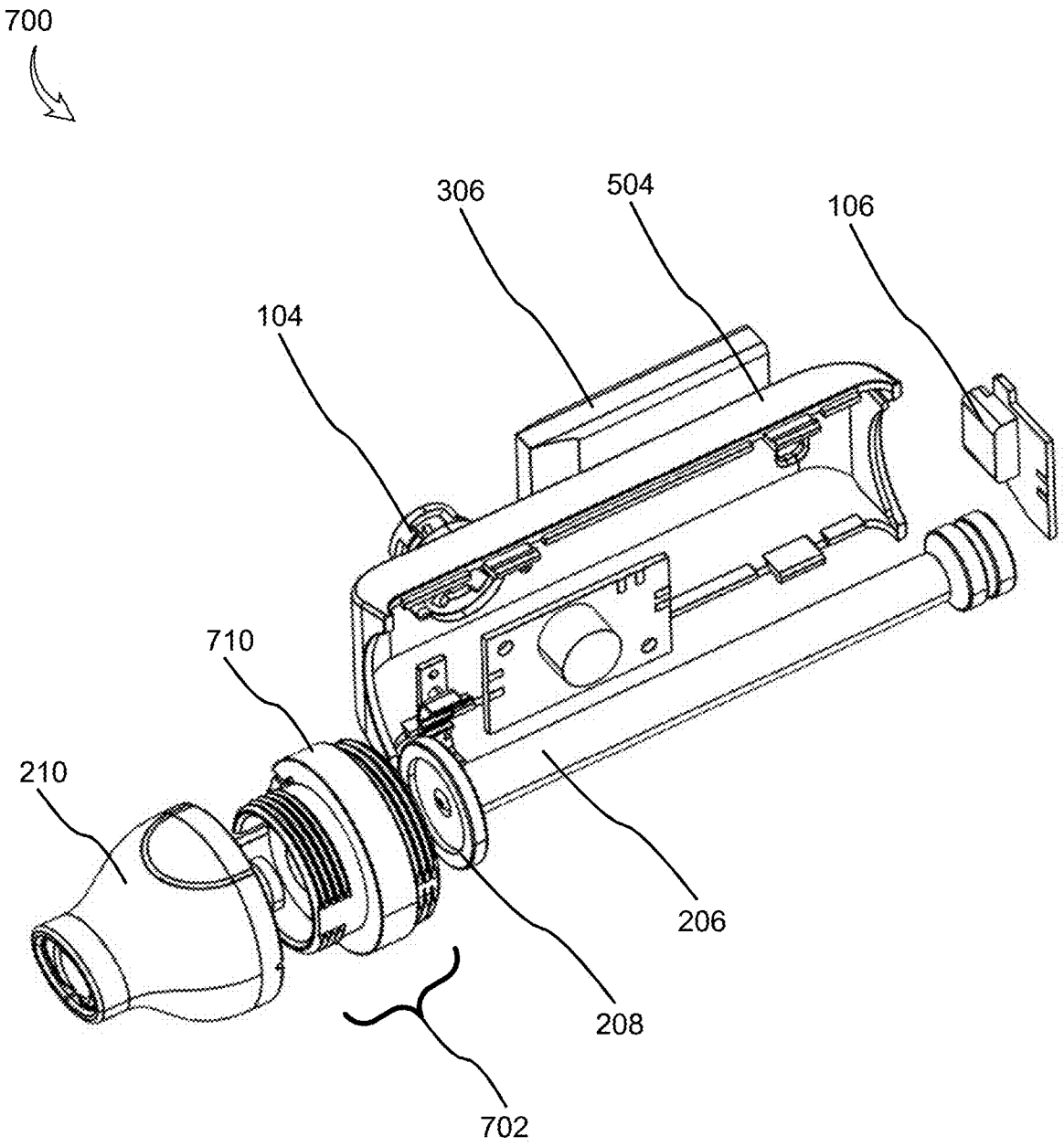
FIG. 7 is an exploded, side-perspective view illustrating one embodiment of a handheld vaping instrument in accordance with the present invention.
Figure 8:
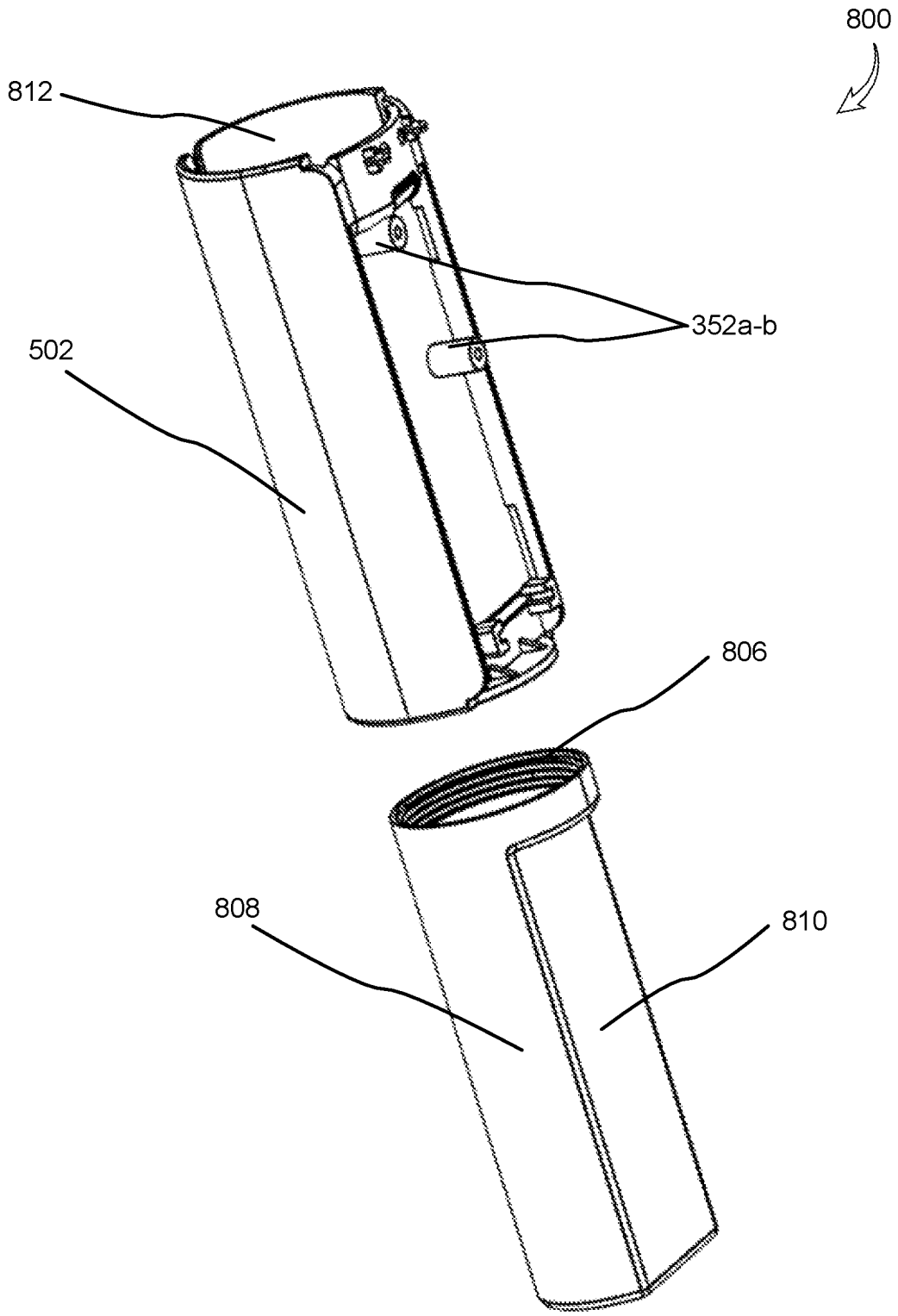
FIGS. 8 and 9 are exploded, perspective views illustrating one embodiment of a handheld vaping instrument in accordance with the present invention.
Figure 9:
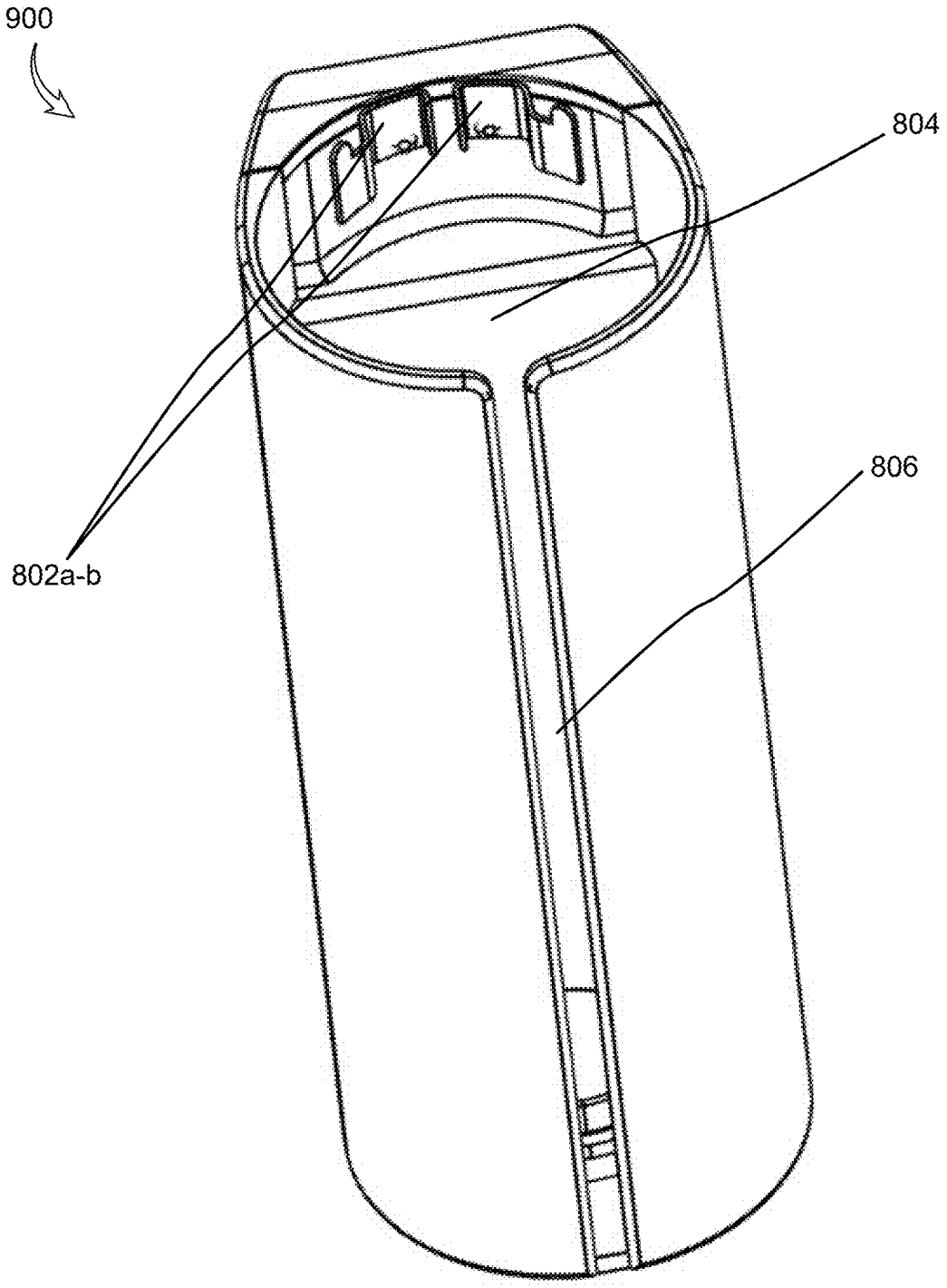

As illustrated in FIG. 5, the device 100 comprises a cylindrical body 502 adapted for handheld operation and uniform dispensing of the composition into a mouth. In one embodiment, the body 102 comprises a generally cylindrical shape affixed to a housing 504. Though in other embodiments, the body 102 may include, without limitation, a rectangular shape, a cubicle shape, and a spherical shape.

The housing 504 provides a gripping surface for enhanced manipulation of the apparatus 500. The interchangeable cartridge 110 is adapted for quickly loading with a hollow cylindrical recess defined by the body 502.

In one embodiment, the interchangeable cartridge cartridge 110 forms a friction fit engagement between an outer surface of the interchangeable cartridge 110 and the surface of the cavity 812. In one possible embodiment, the coupling mechanism is a snap-fit connection. In another embodiment, the coupling mechanism is a pressurized twist connection having threaded surfaces 806. In yet another embodiment, the coupling mechanism enables the interchangeable cartridge 110 to clip in and out of the interior chamber through one-handed manipulation.

The interchangeable cartridge 110 inserts into a cavity 812. The cavity 812 is sized and dimensioned to contour an exterior surface of the cartridge 110. The cavity 812 forms an inlet for the detachable cartridge 110.

Two conductive connection points 604*a-b* position on an exterior surface of the cartridge 110, adapted to come into contact with corresponding connection points within the cavity 812.

The cartridge 110 may comprise a coupler 702 having an annular flange 710 and two threaded surfaces, one of which is adapted to mate with an interiorly threaded surface 806 on a cylindrical component 808.

In various embodiments, the cartridge 110 and/or cavity 812 into which the cartridge 110 inserts have one or more planar facets 810 adapted to ensure the cartridge 110 is properly oriented within the cavity 812.

In various embodiments, the atomizer 208 comprises an ultrasonic nozzle having one or more piezoelectric plates or transducers (including piezoelectric ceramic elements) for atomizing fluid in the container 110.

Manipulation of the button actuates the atomizer 208. The button 104 may be either manually-operable or electrically operable. The button 104 may partially protrude from the side of the body 502 for facilitated manipulation. In one embodiment, the button (or trigger mechanism) 104 is a switch that is disposed centrally along the length of the body 502 or base 102 and operatively connected to a pump adapted to pump fluid in the detachable cartridge 110 to the atomizer 208.

The device 100-800 comprises substantially, a detachable cartridge 110; a body (or base) 102, 502; and an atomizer 208. The interchangeable cartridge 110 quickly loads and unloads into the interior chamber of the container 502 through a quick release coupling mechanism. An atomizer 208 atomizes eclectic types of compositions in the form of a mist for vaping purposes.

The atomized liquid is dispelled from the misting nozzle 202. In various embodiments, the detachable cartridge 110 comprises one or more conductive elements which engage (or come in contact with) one or more corresponding conductive elements in the body 502, 102. When the cartridge 100 is inserted into the body 502, 110, there is electrical conductivity between the triggering mechanism 104 and the atomizer 208. The triggering mechanism 104 may be activated by depression. The atomizer 208 is in logical connectivity with the triggering mechanism 104 and/or a power supply such as a battery 306.

In various other embodiments of the present invention, the cartridge 110 and/or body 502, 102 of the devices 100-800 may comprise circuitry which is configurable to adjust the rate at which the piezo plate atomizes fluid. The circuitry may include computer readable memory which stores historical data about user usage of the device, including which cartridge is used, how long it has been used, and how much liquid is remaining in the cartridge. The historical data may be analyzed by a DBMS (database management system) and historical reports displayed graphically. The historical data may also be used to automatically order replacement cartridges for the device 100, and other purposes.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A vaping apparatus for dispensing of a composition, the vaping apparatus comprising:

body comprising a rechargeable battery and a depressible triggering mechanism, the body defining a hollow interior recess and an open top end defining a track within which a protuberance travels;

a detachable, interchangeable cartridge adapted to insert into the open top end, the cartridge detachably engageable with the body, the detachable interchangeable cartridge comprising:

a transparent reservoir having reservoir exterior surfacing, the transparent reservoir defining two conductor channels running longitudinally;

a base affixed to the transparent reservoir comprising a protuberance, the base having exterior surfacing recessed inwardly from the reservoir exterior surfacing, the base adapted to insert into the open top end;

two elongated, metal conductors each positioned within one of the conductor channels;

a ceramic wick adapted to direct fluid housed within the transparent reservoir to a piezo plate;

the piezo plate disposed above the ceramic wick; and a frustoconical tip having an open top end positioned above the transparent reservoir.

2. The vaping apparatus of claim 1, further comprising a USB charging port.

3. The vaping apparatus of claim 1, further comprising a tray inserted into the hollow interior recess adapted to secure the power supply and a triggering mechanism, the tray having a planar top surface defining two or more apertures and a hollow cylindrical recess.

4. The vaping apparatus of claim 3, further comprising a plurality of magnets disposed across the top surface of the tray and the base adapted to form a magnetic fit between the tray and the detachable cartridge.

5. The vaping apparatus of claim 3, wherein the tray further comprises a plurality of threaded protuberances adapted to affix the tray to other components.

6. The vaping apparatus of claim 1, wherein the body is fabricated from a metal alloy.

7. The vaping apparatus of claim 1, wherein an outlet of the vaping apparatus comprises an atomizer nozzle.

* * * * *